US011293717B2

(12) United States Patent
Bowmar

(10) Patent No.: US 11,293,717 B2
(45) Date of Patent: Apr. 5, 2022

(54) PEEP TUNER AND DRAW TIMER

(71) Applicant: Joshua Todd Bowmar, Ankeny, IA (US)

(72) Inventor: Joshua Todd Bowmar, Ankeny, IA (US)

( * ) Notice: Subject to any disclaimer, the term of this patent is extended or adjusted under 35 U.S.C. 154(b) by 0 days.

(21) Appl. No.: 17/339,678

(22) Filed: Jun. 4, 2021

(65) Prior Publication Data

US 2022/0049922 A1 Feb. 17, 2022

Related U.S. Application Data

(63) Continuation-in-part of application No. 16/990,918, filed on Aug. 11, 2020, now abandoned.

(51) Int. Cl.
*F41B 5/14* (2006.01)

(52) U.S. Cl.
CPC ..... *F41B 5/1419* (2013.01)

(58) Field of Classification Search
CPC ..... F41B 5/1419; F41B 5/1403; F41G 1/467
USPC ..... 124/87, 90; 33/265
See application file for complete search history.

(56) References Cited

U.S. PATENT DOCUMENTS 3,612,029 A * 10/1971 Carroll ..... F41B 5/1407 124/92
3,703,771 A * 11/1972 Saunders ..... F41B 5/1419 124/90
3,859,733 A * 1/1975 Chesnick ..... F41B 5/1419 33/265
4,011,853 A * 3/1977 Fletcher ..... F41G 1/467 124/90
4,563,821 A * 1/1986 Saunders ..... F41B 5/1419 33/265
4,656,747 A * 4/1987 Troncoso ..... F41G 1/467 124/90
4,833,786 A * 5/1989 Shores, Sr. ..... F41G 1/01 42/133
4,895,129 A * 1/1990 Hedgpeth ..... F41B 5/1419 124/90
4,934,332 A * 6/1990 Scherz ..... F41B 5/1419 124/90
4,965,938 A * 10/1990 Saunders ..... F41G 1/467 124/87
5,347,976 A * 9/1994 Saunders ..... F41G 1/467 124/90
5,542,186 A * 8/1996 Saunders ..... F41B 5/1419 124/87
5,676,123 A * 10/1997 McPherson ..... F41B 5/1419 124/90

(Continued)

*Primary Examiner* — Alexander R Niconovich

(57) ABSTRACT

A peep sight is a tubular element installed in a bowstring. When drawn, the natural twist of the bowstring may fail to align the peep sight with the other sighting structures on the bow. The invention provides a simple, low-cost, and easily installed bead which, when inserted into a bowstring in the vicinity of the peep sight, may be easily adjusted to bring the peep sight into proper alignment. Once properly adjusted and secured to the bowstring, the inventive peep tuner acts to reliably and repeatably counteract the change in helical twist of the bowstring strands and bring the peep sight to its desired orientation when the bowstring is fully drawn. The bead may also be installed elsewhere along the bowstring as a draw timer to take up excess bowstring length which would pay out unequally during a draw if left uncorrected.

16 Claims, 6 Drawing Sheets

(56) References Cited

U.S. PATENT DOCUMENTS 6,058,921 A * 5/2000 Lawrence ..... F41B 5/1419 124/87
6,282,800 B1 * 9/2001 Beutler ..... F41G 1/467 124/87
6,679,242 B1 * 1/2004 Martin ..... F41B 5/1426 124/90
6,860,021 B1 * 3/2005 Connelly, III ..... F41B 5/1419 124/87
6,981,329 B1 * 1/2006 Strathman ..... F41G 1/08 124/87
7,543,389 B2 * 6/2009 Grace, Jr. ..... F41B 5/1419 124/87
7,810,481 B2 * 10/2010 Sterner ..... F41G 1/08 124/90
8,201,339 B1 * 6/2012 Walker ..... F41G 1/467 124/87
8,281,777 B2 * 10/2012 Bach ..... F41B 5/1426 124/90
8,336,533 B2 * 12/2012 Bach ..... F41B 5/14 124/92
8,453,336 B2 * 6/2013 LoRocco ..... F41G 1/467 124/87
8,544,180 B2 * 10/2013 Minica ..... F41G 1/08 124/90
9,212,866 B1 * 12/2015 Hakl ..... F41B 5/1419
9,829,278 B2 * 11/2017 Wolf ..... F41G 1/467
10,012,473 B2 * 7/2018 Munsell ..... F41B 5/1419
10,161,708 B1 * 12/2018 Ady ..... F41B 5/1419
10,161,719 B2 * 12/2018 Burgaleta Sanchez ..... F41G 1/467
10,345,072 B1 * 7/2019 Webster ..... F41B 5/1411
10,359,252 B2 * 7/2019 Ady ..... F41B 5/1411
10,436,542 B1 * 10/2019 Karcher ..... F41G 1/467
10,852,096 B2 * 12/2020 Schuster ..... F41G 1/467
10,883,792 B1 * 1/2021 McCarthy ..... F41B 5/148
2008/0066328 A1 * 3/2008 Bohn ..... F41G 1/467 124/87

* cited by examiner

PEEP TUNER AND DRAW TIMER

CROSS REFERENCE TO RELATED APPLICATION

This non-provisional utility application is a continuation in part of U.S. Utility application Ser. No. 16/990,918 "Peep Tuner and Draw Timer," filed 11 Aug. 2020. The entire contents of Utility application Ser. No. 16/990,918 "Peep Tuner and Draw Timer," filed 11 Aug. 2020 are hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to archery accessories which assist sighting of a drawn bow.

BACKGROUND

Peep sights are optical sighting aids used in archery that typically include a tube section installed along the bowstring so that an archer may peer through the tube at other sighting structures on the bow and the target beyond, and align the set of sighting structures to make the shot.

One major difficulty with peep sights occurs because the twist of the helically oriented strands of the bowstring changes as the bowstring is drawn, like the way the helical pitch of a coil spring changes when stretched. This change in twist makes it difficult to install a peep sight within the strands of bowstring so that aligns itself correctly along the archer's desired line of sight while the bowstring is drawn.

A common way to attempt to solve this problem is to tie an auxiliary strand of elastic material from an anchor point on the bow frame to a point on the peep sight so that when drawn, this stretched strand properly orients the peep sight tube. Unfortunately, the material strength of the auxiliary strand may deteriorate over time and it may fail without warning and the strand portion attached to the peep sight whips back directly at the archer's eye. These accidents have caused serious injuries to the eye and the face of archers.

Another way to attempt to solve this problem requires a very expensive and bow press which compresses the bow to allow the archer to remove the string, and then attempt by trial and error to establish a pre-compensating twist in the string which would align it accurately with the housing of the sight by chance. A bow press is a specialized piece of equipment most archers do not have or know how to use, considering that it takes years of training experience to do this level of bow tuning.

Yet another problem which occurs using compound bows is that the cams or pulleys which pay out the bowstring may not be properly coordinated with a draw stop mechanism in the bow. The draw stop may deleteriously lock one cam before the other so that one portion of the unwinding bowstring is halted before the other. Continuing to draw on the bowstring causes the nock of the arrow to rise or drop out of its vertical position with respect to the rest of the bow system and may also cause the archer to tilt the bow to compensate, which addles the archer's aim. When an arrow is loosed from such a launch condition, its tail gets vertically jostled during its acceleration from the bow, further disturbing its accuracy in flight.

BRIEF DESCRIPTION

A primary objective of the invention is to provide a peep tuner, a device which adjustably orients a peep sight installed into a bowstring so that the peep sight becomes correctly aligned with the other sighting structures of the bow every time the bowstring is drawn. A corollary objective of the invention is to eliminate the necessity of any further adjustments to such a peep tuner after it is installed, adjusted, and secured.

Another objective of the invention is to eliminate the need to use a dangerous solution to the problem of ensuring that a peep sight is properly aligned when the bowstring is drawn, and thus eliminate a cause of serious ocular or facial injury to archers when attempting to adjust the peep sight at full draw.

Yet another objective of the invention is to provide a mechanically simple and low-cost product which may be installed and adjusted easily and effectively. For ease of use and accurate location, the peep tuner should also be easily slidable along a length of bowstring. A corollary objective of the invention is to enable archers to install and adjust a peep sight into a bowstring without the use of expensive or complicated tools such as a bow press, which as explained above, are not available to the average archer and require great skills to use correctly and the time to accumulate those skills.

Another ease of use factor is how is easily a user can insert the bead in between the bowstring strands and how easily it may be slid along the length of the bowstring while the string is taut. Other products can only be moved along the length of a bowstring while slack, which requires the user either to have and be skilled with a bow press or to seek out a skilled workshop. If a peep tuner cannot be adjusted while the bowstring is taut, then field adjustments are all but impossible.

A yet further objective of the invention is to provide a bowstring draw coordinator (aka "draw timer") which can selectively shorten a portion of a bowstring in a compound bow so that when the draw stop arrests payout of the bowstring, both the upper and lower portions of the bowstring leaving the arrow nock are halted simultaneously.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Where figures depict a user, any resemblance to actual persons or copyrighted characters is entirely coincidental and irrelevant to the material being disclosed and explained. Also, regardless of appearances as depicted, a user may be of any gender or physique and the specificities of the artworks presented herein are in no way intended to exclude or limit any range or types of persons who may enjoy the benefits of the invention.

Figure 1A:
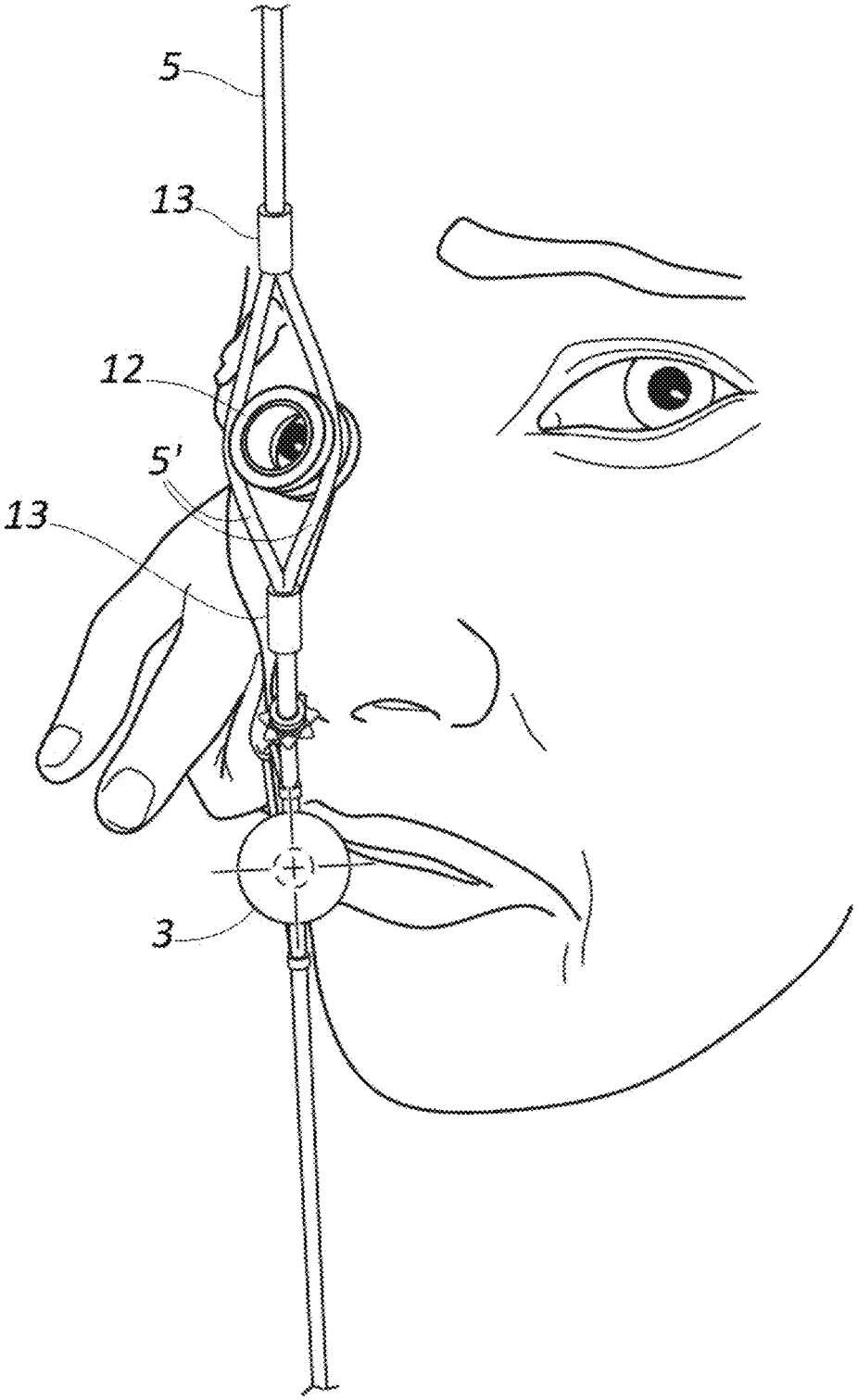
FIG. 1*a* shows a front view of an archer using a peep sight incorporated into a bowstring.

Referring now to the figures, FIG. 1*a* shows a front view of an archer using a peep sight [12] incorporated into a bowstring [5.] The bowstring comprises a plurality of fibers lain helically along its length. As the bowstring is drawn, the increase in tension stretches the bowstring, which changes the pitch angle of its fibers in much the same way that stretching a helical coil spring changes the pitch and angles of its coils. A peep sight typically comprises an optical tube, and is installed by bifurcating roughly equal amounts of bowstring fibers on opposite sides of this tube. The tube is secured in place at a convenient site along the length of the bowstring so that when the drawn bow is raised to shoot, the peep sight will align with the archer's aiming eye.

Once an archer determines the best location for the peep sight, it is typically secured using serving [13,] which is a strand of tough material of great tensile strength and of a substantially smaller diameter than the bowstring. When looped taut one or more times around a bowstring and tied securely, serving locally chokes down the diameter of the bowstring and resists longitudinal slipping along the length of the bowstring. Thus, objects inserted transversely through bifurcated sections [5'] of bowstring may be fixed in place by tying multiple loops of serving on both sides of the object being secured.

The archer in this figure has nocked an arrow [3] which appears foreshortened as it is pointing out of the plane of the figure. Because it is nearly impossible to predict the change in helical twist when a bowstring is brought to tension as it is drawn, the sighting axis of the peep sight often twists out of alignment with the archer's intended sighting direction, reducing its ease of use or rendering it entirely unusable. An archer must then slacken or remove the bowstring and radially re-position the peep sight in the string using trial and error until the intended alignment is happened upon.

The inventive peep tuner eliminates these repetitive trials and enables an archer to install and secure a peep sight at its preferred location and orientation within the bowstring as a simple and singular task.

Figure 1B:
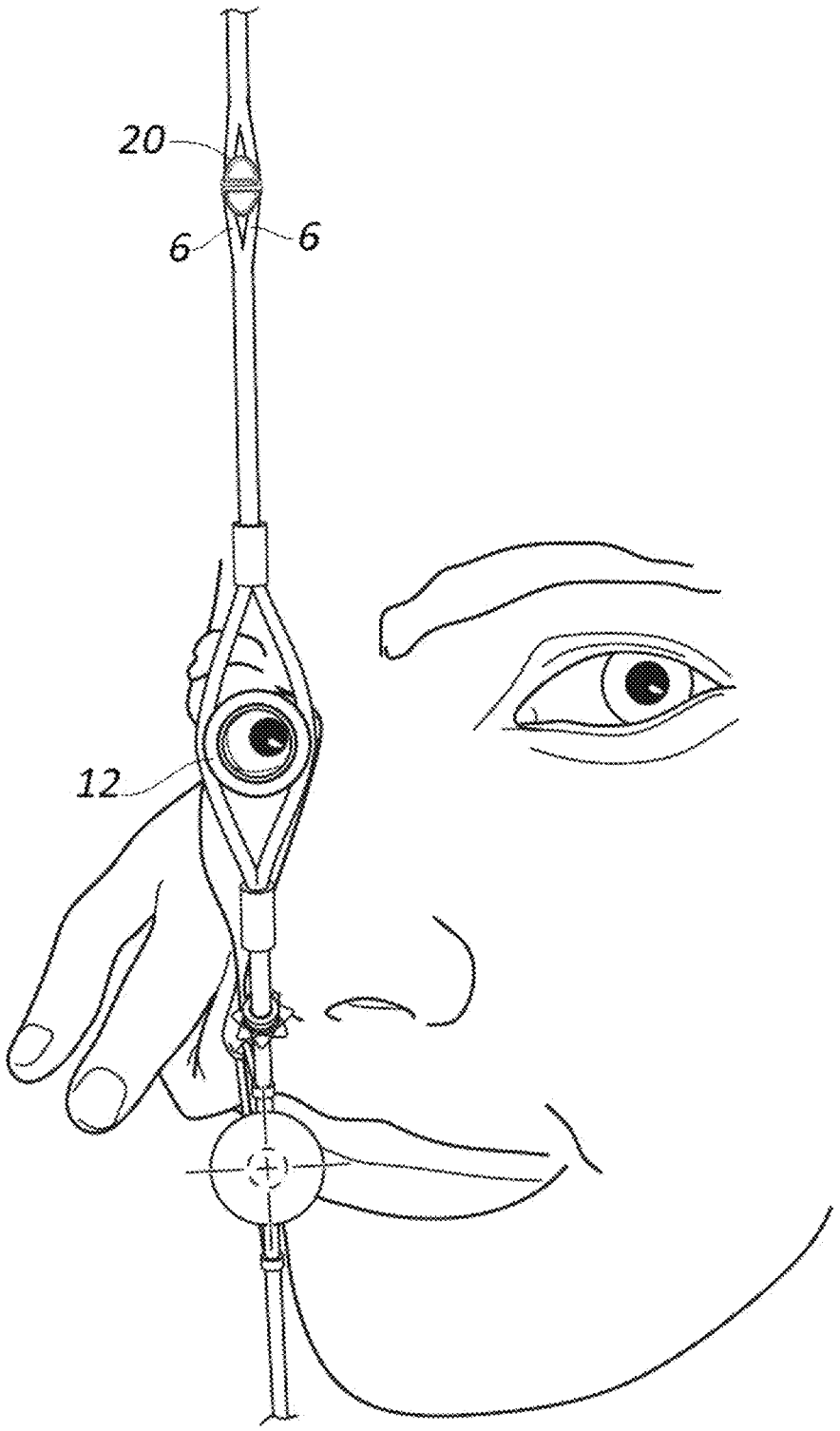
FIG. 1*b* shows a front view of an archer using a peep sight and an embodiment of the inventive peep tuner incorporated into a bowstring.

FIG. 1*b* shows a front view of an archer using a peep sight [12] and an embodiment of a peep sight adjuster [20] in accordance with the invention incorporated into a bowstring. The peep sight adjuster in this specification may also be referred to informally as a "peep tuner." With the peep sight installed at a first site along a length of bowstring by bifurcating its fibers around it, the peep tuner is an object which inserts within the bowstring with fibers bifurcated [6] around it at a second site. With the peep sight fully secured at its first site, the peep tuner may be easily slid up or down along the bowstring until the peep sight axis aligns with the archer's sighting direction. The steep helical angle of the fibers of the bowstring allow fine angular adjustments of the peep sight, enabling the archer to point it with great exactitude before securing it to the bowstring.

With the installation completed as shown, it is seen that at least one installation of serving used to secure the peep sight will reside at a point between the first and second site. Depending on the size and type of peep sight used, it may be preferable to install serving at a point within 3 inches from the second site.

Figure 2A:
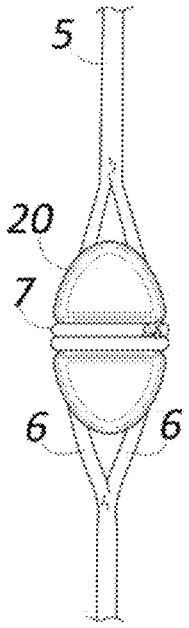
FIG. 2*a* shows a front view of an embodiment of a peep tuner in accordance with the invention, incorporated into a bowstring and secured therein with serving.

FIG. 2*a* shows a front view of an embodiment of a peep tuner [20] in accordance with the invention, incorporated into a bowstring [5] and secured therein with serving [7.] The peep tuner bifurcates [6] the bowstring and the serving when drawn taught around the peep tuner, locally compresses the bowstring fibers to lock the bead at its desired site along the bowstring. For ease of sliding the peep tuner to its desired location along a bow-string, its material should preferably resist compression, resist binding to the bowstring strands, and resist indentation by the bowstring strands while it is situated between the bifurcated sets of bowstring strands. Therefore, some preferred materials include cross-linked nylons such as 4,6 polyamide or 6,6 polyamide. Other plastics such as polypropylene or metal materials may also be used, and it may be possible to make the invention out of natural materials such as wood or bone for ornamentality, but thermoplastics are more preferred, and a most preferred material is acrylonitrile butadiene styrene (ABS) because users are able to melt a peep tuner in place by applying moderate heat such as from an open flame lighter or a soldering iron. Delrin® which is a thermoplastic also called acetal or polyoxymethylene (POM,) polyacetal, or polyformaldehyde, may also be used as a material for the peep tuner. Thermoplastic materials may be heated and deformed several times while retaining adequate mechanical properties to serve as a peep tuner.

Figure 2B:
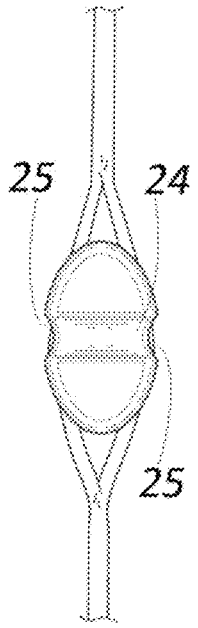
FIG. 2*b* shows the embodiment of the peep tuner of FIG. 2*a* but with the serving removed for clarity.

FIG. 2*b* shows the embodiment of the peep tuner of FIG. 2*a* but with the serving removed for clarity. The peep tuning bead further comprises equatorially aligned notches [25] and grooves [24] into which the serving is received when secured to the bowstring. When the serving is knotted tightly, the peep tuner is firmly fixed in place.

Figure 3A:
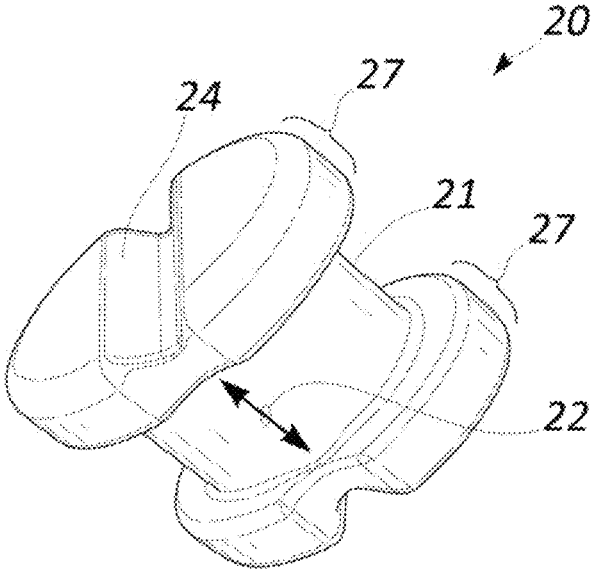
FIG. 3*a* shows a front, bottom, right view of the of FIG. 2*a*.

FIG. 3*a* shows a front, bottom, right view of the peep tuner of FIG. 2*a*. The peep tuner [20] comprises a central column portion [21] extending along a longitudinal axis depicted by the double arrow [22.]

The solid column extends along a longitudinal axis from a first end to a second end [27] which are anvils having end faces [27,] and the end face shown has a groove [24] extending across it. In a preferred embodiment, the opposite end anvil not shown is identical to the one shown and it too also has a groove running across its end face.

Figure 3B:
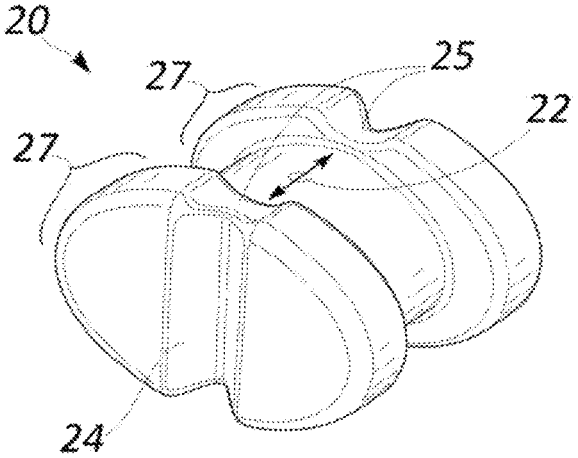
FIG. 3*b* shows a front, top, right view of the peep tuner of FIG. 2*a*.

FIG. 3*b* shows a front, top, right view of the peep tuner [20] of FIG. 2*a* with a longitudinal axis depicted by the double arrow [22.] Of the two end anvils [27,] the end face of at least one has a groove extending across it and at least one notch. In a preferred embodiment, each end anvil is notched at both ends of the groove [24] in its end face and the grooves in both end faces define groove axes, the axes of both grooves are coplanar, and the notches [25] in the perimeter of the first end anvil are aligned with corresponding notches in the perimeter of the second end anvil. For example, if the notch is a first notch residing in the first end anvil, then the second end anvil also comprises a second notch longitudinally aligned with the first notch.

Figure 3C:
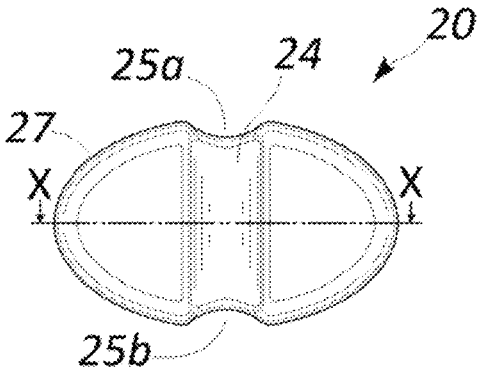
FIG. 3*c* shows another front view of the peep tuner of FIG. 2*a*, with a cross section line X-X.

FIG. 3*c* shows another front view of the peep tuner [20] of FIG. 2*a*, with a cross section line X-X located in a plane of symmetry for the column and extending in a first direction perpendicular to the longitudinal axis of the bead which also resides in the plane of symmetry. The groove [24] in the end face of the first, or front end anvil [27] extends in a second direction orthogonal to the first direction, and the perimeter of the end anvil includes two notches, one at each end of the groove. In this embodiment a first notch [25*a*] resides in the first end anvil with a second notch [25*b*] symmetrically opposite to the first notch. Also in this embodiment the second, or back end anvil opposite the front end is identical to the front end anvil and its two notches are aligned with the front end anvil notches. The first end of the first groove in the end face of the first anvil meets with a first notch in a perimeter of the first anvil, with the first notch extending parallel to the longitudinal axis.

Figure 3D:
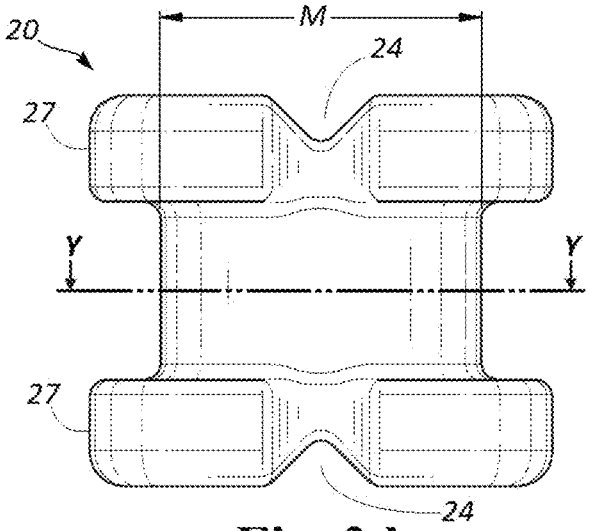
FIG. 3*d* shows a top view of the peep tuner of FIG. 2*a*, with a cross section line Y-Y.

FIG. 3*d* shows a top view of the peep tuner [20] of FIG. 2*a*, with a cross section line Y-Y taken perpendicular to the longitudinal axis of the central column portion. The cross section of the central column portion extends to a first transverse column thickness "M" in a first transverse direction of section line X-X of FIG. 3*c*, which is orthogonal to the longitudinal axis. In this view it is seen that the grooves [24] in the end faces of the end anvils [27] are aligned with each other and also aligned with the notches in the perimeters of the end anvils.

Figure 3E:
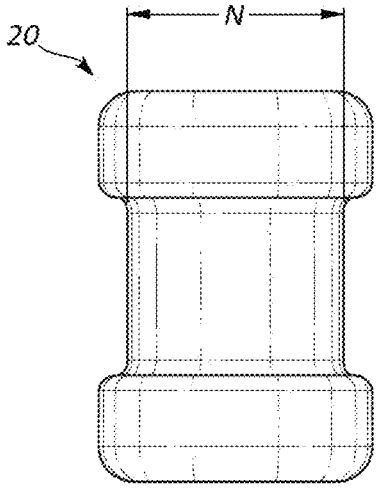
FIG. 3*e* shows a side view of the peep tuner of FIG. 2*a*.

FIG. 3*e* shows a side view of the peep tuner [20] of FIG. 2*a*. The central column portion extends to a second transverse column thickness "N" in a second transverse direction which is orthogonal to or perpendicular to both the longitudinal axis and the first transverse thickness direction seen in FIG. 3*d*, because FIG. 3*e* is an orthographic projection of FIG. 3*d*. In a preferred embodiment, the first and second anvils each have a first width dimension in the first transverse direction greater than the first transverse column thickness, and a second width dimension in the second transverse direction greater than the second transverse column thickness.

Figure 4A:
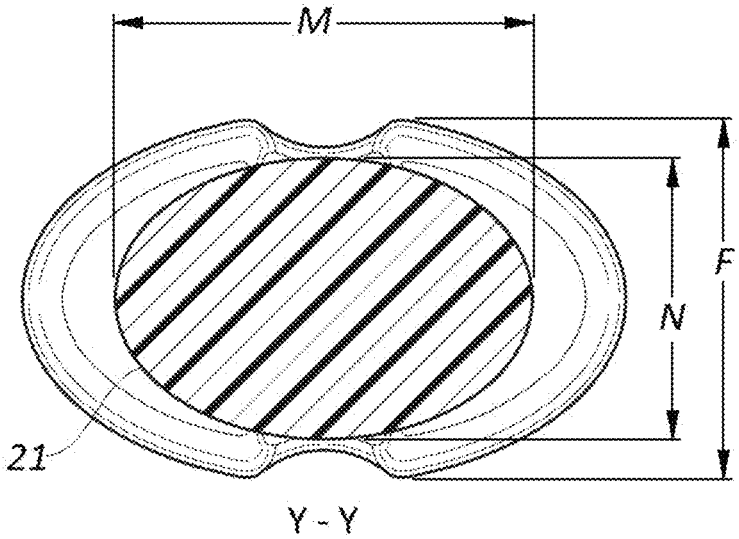
FIG. 4*a* shows a cross section view of the peep tuner of FIG. 2*a*, taken at section line Y-Y of FIG. 3*d*.

FIG. 4*a* shows a cross section view of the peep tuner of FIG. 2*a*, taken at section line Y-Y of FIG. 3*d*. The hatched section in this view is the central column portion [21,] which in this embodiment is an elliptical cross section having a first thickness of a dimension "M" extending in the first direction defined previously, and a second thickness of a dimension "N" extending in a second direction perpendicular to the longitudinal axis and orthogonal to the first direction. The end anvils extend in the second direction to a width dimension "F" greater than the second thickness of the central column. Although in this embodiment shown the end anvils extend symmetrically greater than the second thickness of the central column portion, it is sufficient that only a portion of one of the end anvils extends in the second direction beyond the second thickness of the central column.

Figure 4B:
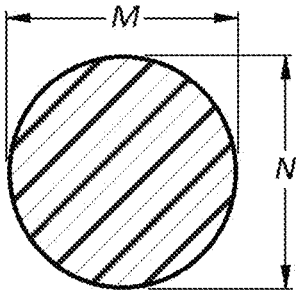
FIG. 4*b* shows a cross section of an alternative embodiment of a peep tuner in accordance with the invention in which the central column portion is circular.

FIG. 4*b* shows a cross section of an alternative embodiment of a peep tuner in accordance with the invention in which the central column portion is circular. In this embodiment the first thickness dimension "M" is the same as the second thickness dimension "N," which is less preferred because the bead could rotate easily while lodged between the bifurcated strands of bowstring [6 in FIG. 2*a*.] In contrast, embodiments in which the first thickness is greater than the second thickness reside more stably within the lozenge shaped gap of the bifurcated strands.

Figure 4C:
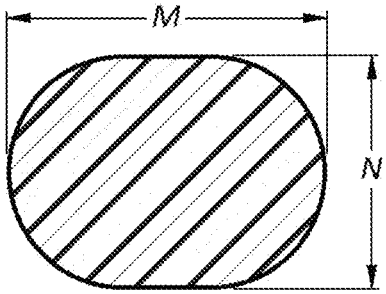
FIG. 4*c* shows a cross section of an alternative embodiment of a peep tuner in accordance with the invention in which the central column portion is an oval.

FIG. 4*c* shows a cross section of an alternative embodiment of a peep tuner in accordance with the invention in which the central column portion is an oval, with the first thickness dimension "M" larger than the second thickness dimension "N."

Figure 4D:
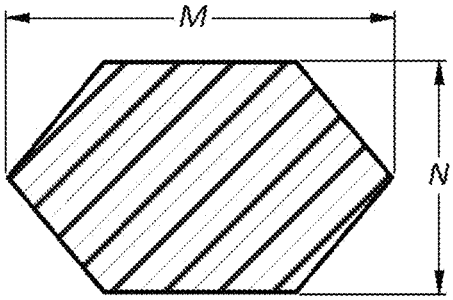
FIG. 4*d* shows a cross section of an alternative embodiment of a peep tuner in accordance with the invention in which the central column portion is a polygon which is an irregular hexagon.

FIG. 4*d* shows a cross section of an alternative embodiment of a peep tuner in accordance with the invention in which the central column portion is a polygon which is an irregular hexagon; two of the opposed flats, which define the second thickness dimension "N" are longer than the other four sides, which come to longitudinally opposed apices which define the first thickness dimension "M" to be larger than "N."

Figure 4E:
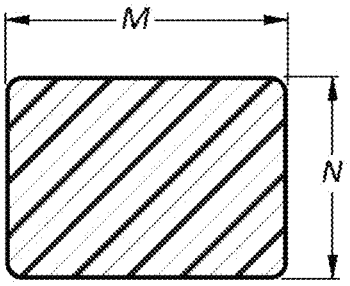
FIG. 4*e* shows a cross section of an alternative embodiment of a peep tuner in accordance with the invention in which the central column portion is a rectangle having rounded corners.

FIG. 4*e* shows a cross section of an alternative embodiment of a peep tuner in accordance with the invention in which the central column portion is rectangle having rounded corners, and having a first thickness dimension "M" larger than the second thickness dimension "N." Furthermore, many polygons and other shapes are contemplated within the scope of the invention, including but not limited to a square, a lozenge, and a rhombus. In these and other cross sectional embodiments, words for various polygonal and geometric shapes listed by name include those having sharp corners or edges and all counterparts having fillets, chamfers, or rounded corners or edges.

Figure 5:
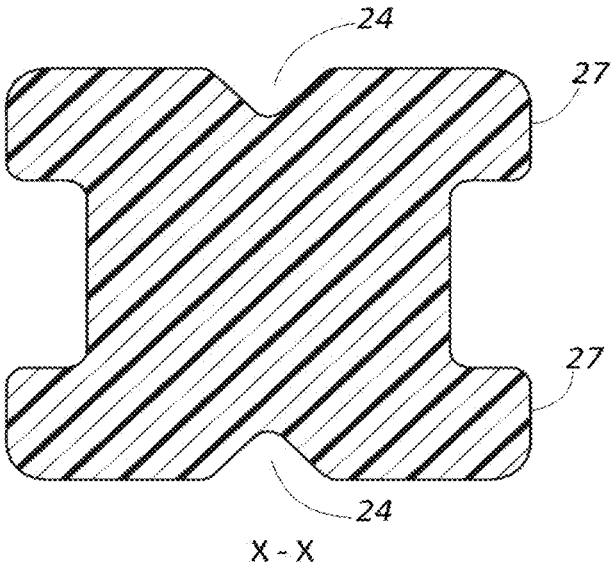
FIG. 5 shows a cross section view of the peep tuner of FIG. 2*a*, taken at section line X-X of FIG. 3*c*.

FIG. 5 shows a cross section view of the peep tuner of FIG. 2*a*, taken at section line X-X of FIG. 3*c*, which shows the grooves [24] which traverse the end faces of its end anvils [27.] In a preferred embodiment, the end face of the first anvil further comprises a first groove, and the end face of the second anvil further comprises a second groove. The grooved anvils admit a field knife for cutting the serving if it is too snug to be untied, while acting as protective flanges which reduce the chance of a knife accidentally cutting into a taut bowstring. In this embodiment a second end of the first groove in the end face of the first anvil meets with a second notch also extending parallel to the longitudinal axis. The first end of the second groove in the end face of the second anvil meets with a third notch in the perimeter of the second anvil, with the third notch extending parallel to the longitudinal axis, in alignment with the first notch in the first anvil.

Figure 6:
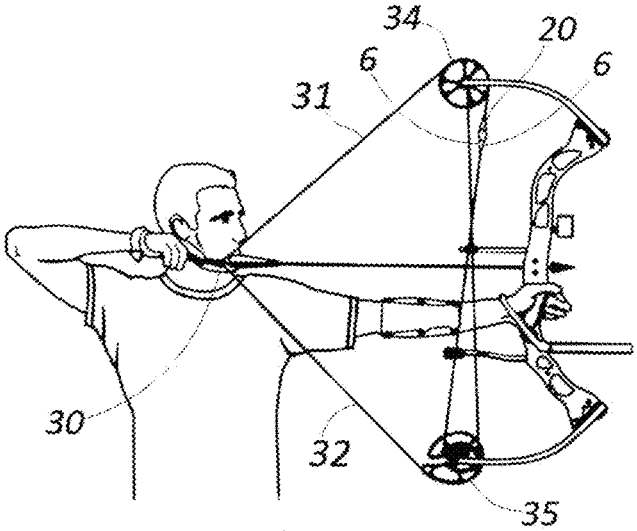
FIG. 6 shows an archer using an embodiment in accordance with the invention in use as a bowstring draw coordinator.

FIG. 6 shows an archer using an embodiment in accordance with the invention as a bowstring draw coordinator, which is more commonly called a "draw timer." When the cams or pulleys which pay out the bowstring are not properly coordinated with a draw stop mechanism in the bow, the draw stop may deleteriously lock one cam [34] before the other [35] so that one portion of the unwinding bowstring is halted before the other. Continuing to draw on the bowstring causes the nock [30] of the arrow to rise or drop out of its vertical position with respect to the rest of the bow system and may also cause the archer to tilt the bow to compensate, which addles the archer's aim. When an arrow is loosed from such a launch condition, its tail gets vertically jostled during its acceleration from the bow, further disturbing its accuracy in flight.

A bowstring draw coordinator [20] (aka "draw timer") may be added to the bowstring assembly to selectively shorten a portion of a bowstring in a compound bow so that when the draw stop arrests payout of the bowstring, both the upper [31] and lower [32] portions of the bowstring leaving the arrow nock are halted simultaneously. Embodiments in accordance with the invention may be produced and furnished in a variety of sizes so that one of the right size may be selected to take up the excess length of bowstring paid out by the cam which is halted late. This excess length is taken up in the bifurcated portions [6] of bowstring which bestride the draw timer installed in the bowstring.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture. Unauthorized instances of apparatuses and methods claimed herein are to be considered infringing, no matter where in the world they are advertised, sold, offered for sale, used, possessed, or performed.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A bowstring peep tuner comprising
- a compression resistant material,
- a solid column extending along a longitudinal axis from a first end to a second end,
- said column having a cross section with
  - a first transverse column thickness in a first transverse direction orthogonal to said longitudinal axis, and a second transverse column thickness in a second transverse direction orthogonal to both said longitudinal axis and said first transverse direction,
- with said first and second ends further comprising respectively a first and second anvil each having
  - a first width dimension in said first transverse direction greater than said first transverse column thickness and
  - a second width dimension in said second transverse direction greater than said second transverse column thickness, and
- with an end face of said first anvil further comprising a first groove, and an end face of said second anvil further comprising a second groove.

2. The bowstring peep tuner of claim 1, wherein said first transverse column thickness is greater than said second transverse column thickness.

3. The bowstring peep tuner of claim 1, wherein said first groove in said end face of said first anvil extends along said first transverse direction, and second groove in said end face of said second anvil extends along said first transverse direction.

4. The bowstring peep tuner of claim 1, wherein a first end of said first groove in said end face of said first anvil meets with a first notch in a perimeter of said first anvil, with said first notch extending parallel to said longitudinal axis.

5. The bowstring peep tuner of claim 4, wherein a second end of said first groove in said end face of said first anvil meets with a second notch also extending parallel to said longitudinal axis.

6. The bowstring peep tuner of claim 4, wherein a first end of said second groove in said end face of said second anvil meets with a third notch in a perimeter of said second anvil, with said third notch extending parallel to said longitudinal axis, in alignment with said first notch in said first anvil.

7. The bowstring peep tuner of claim 1, wherein said cross section of said solid column comprises a shape selected from a set of shapes consisting of:

a circle, a polygon, a square, a rectangle, an oval, an ellipse, a lozenge, a hexagon, and a rhombus.

8. The bowstring peep tuner of claim 1, wherein said compression resistant material comprises a material selected from a set of materials consisting of:

a thermoplastic, an acrylonitrile butadiene styrene, a nylon, a polyamide, 4,6 polyamide, 6,6 polyamide, a polypropylene, Delrin®, acetal, or polyoxymethylene, polyacetal, or polyformaldehyde, a metal, wood, and bone.

9. An archery bowstring assembly comprising:

a plurality of fibers lain helically along a length of a bowstring, said fibers bifurcated around a peep sight at a first site along said length of said bowstring, and said fibers bifurcated around a peep tuner at a second site along said length of said bowstring, wherein said peep tuner further comprises a compression resistant material, a solid column extending along a longitudinal axis from a first end to a second end, said column having a cross section with a first transverse column thickness in a first transverse direction orthogonal to said longitudinal axis, and a second transverse column thickness in a second transverse direction orthogonal to both said longitudinal axis and said first transverse direction, with said first and second ends further comprising respectively a first and second anvil each having a first width dimension in said first transverse direction greater than said first transverse column thickness and a second width dimension in said second transverse direction greater than said second transverse column thickness, and with an end face of said first anvil further comprising a first groove, and an end face of said second anvil further comprising a second groove.

10. The archery bowstring assembly of claim 9, further comprising serving secured to said bowstring and received within said first groove of said first anvil.

11. The archery bowstring assembly of claim 9, wherein said first groove in said end face of said first anvil of peep tuner extends along said first transverse direction, and second groove in said end face of said second anvil extends along said first transverse direction, and further comprising serving secured to said bowstring and received within said first groove of said first anvil and said second groove of said second anvil.

12. The archery bowstring assembly of claim 11, wherein a first end of said first groove in said end face of said first anvil of said peep tuner meets with a first notch in a perimeter of said first anvil, with said first notch extending parallel to said longitudinal axis, and further comprising serving secured to said bowstring and received within said first groove of said first anvil and said first notch of said first anvil.

13. The archery bowstring assembly of claim 9, wherein a cross section of said solid column of said peep tuner comprises a shape selected from a set of shapes consisting of:

a circle, a polygon, a square, a rectangle, an oval, an ellipse, a lozenge, a hexagon, and a rhombus.

14. The archery bowstring assembly of claim 9, wherein said compression resistant material comprises a material selected from a set of materials consisting of:

a thermoplastic, an acrylonitrile butadiene styrene, a nylon, a polyamide, 4,6 polyamide, 6,6 polyamide, a polypropylene, Delrin®, acetal, or polyoxymethylene, polyacetal, or polyformaldehyde, a metal, wood, and bone.

15. The archery bowstring assembly of claim 9, further comprising serving secured to said bowstring at a point between said first site and said second site.

16. The archery bowstring assembly of claim 9, further comprising serving secured to said bowstring at a point within 3 inches from said second site.

* * * * *